US009879530B2

(12) United States Patent
LopezGarcia et al.

(10) Patent No.: US 9,879,530 B2
(45) Date of Patent: Jan. 30, 2018

(54) METHOD AND SYSTEM OF SELECTING HYDROCARBON WELLS FOR WELL TESTING

(71) Applicant: LANDMARK GRAPHICS CORPORATION, Houston, TX (US)

(72) Inventors: Carlos M. LopezGarcia, Katy, TX (US); Alvin S. Cullick, Houston, TX (US); Giuseppe Moricca, Codogno (IT); Gustavo A. Carvajal, Houston, TX (US); Jose A. Rodriguez, Katy, TX (US)

(73) Assignee: LANDMARK GRAPHICS CORPORATION, Houston, TX (US)

( * ) Notice: Subject to any disclaimer, the term of this patent is extended or adjusted under 35 U.S.C. 154(b) by 0 days.

(21) Appl. No.: 14/113,600

(22) PCT Filed: Mar. 13, 2013

(86) PCT No.: PCT/US2013/030941
§ 371 (c)(1),
(2) Date: Oct. 24, 2013

(87) PCT Pub. No.: WO2013/172945
PCT Pub. Date: Nov. 21, 2013

(65) Prior Publication Data

US 2014/0114577 A1 Apr. 24, 2014

Related U.S. Application Data

(60) Provisional application No. 61/646,407, filed on May 14, 2012.

(51) Int. Cl.
*E21B 49/00* (2006.01)
*E21B 49/08* (2006.01)

(52) U.S. Cl.
CPC ..... *E21B 49/00* (2013.01); *E21B 49/087* (2013.01)

(58) Field of Classification Search
CPC ..... E21B 49/087
USPC ..... 702/13
See application file for complete search history.

(56) References Cited

U.S. PATENT DOCUMENTS 6,978,210 B1 12/2005 Suter et al.
8,131,470 B2 * 3/2012 Yusti ..... E21B 43/00 702/12
2002/0184940 A1 * 12/2002 Storm et al. ..... 73/32 A
2003/0047308 A1 3/2003 Hirsch et al.
2003/0050758 A1 3/2003 Soliman et al.
(Continued)

FOREIGN PATENT DOCUMENTS

RU 2416719 C1 4/2011

OTHER PUBLICATIONS

PCT International Search Report and Written Opinion, application No. PCT/US2013/030941, dated Jul. 15, 2013.
(Continued)

*Primary Examiner* — John Breene
*Assistant Examiner* — Yaritza H Perez Bermudez

(57) ABSTRACT

Selecting hydrocarbon wells for well testing. The selecting may include identifying hydrocarbon wells whose last well test took place prior to a predetermined date; identifying hydrocarbon wells with a parameter that exceeds a predetermined threshold; and selecting a predetermined number of hydrocarbon wells from the wells identified.

23 Claims, 5 Drawing Sheets

(56) References Cited

U.S. PATENT DOCUMENTS

| | | | | |
|---|---|---|---|---|
| 2003/0110017 | A1 | 6/2003 | Guthrie et al. | |
| 2004/0068375 | A1* | 4/2004 | Cook et al. | 702/11 |
| 2004/0114464 | A1* | 6/2004 | Cook et al. | 367/25 |
| 2006/0047527 | A1 | 3/2006 | Caveny et al. | |
| 2007/0144738 | A1* | 6/2007 | Sugiyama et al. | 166/250.07 |
| 2009/0084545 | A1 | 4/2009 | Banerjee et al. | |
| 2009/0125367 | A1 | 5/2009 | Brink et al. | |
| 2009/0299636 | A1 | 12/2009 | Carnegie et al. | |
| 2010/0214120 | A1 | 8/2010 | Means et al. | |
| 2011/0168391 | A1 | 7/2011 | Saleri et al. | |

OTHER PUBLICATIONS

Russian Patent Office, Search Report, dated Oct. 1, 2015, 4 pages, Russia.

European Patent Office, Supplementary European Search Report, dated Jun. 1, 2016, 6 pages, Europe.

Petroleum Experts Ltd., An Online Field Management Workflow Platform, Jan. 1, 2010, 12 pages, United Kingdom.

* cited by examiner

METHOD AND SYSTEM OF SELECTING HYDROCARBON WELLS FOR WELL TESTING

BACKGROUND

Well testing, with regard to previously completed hydrocarbon wells, is a system where a mobile unit containing various metering units, separators, and heaters temporarily diverts the hydrocarbon flow from the hydrocarbon well through the equipment of the mobile unit before flowing into the production line. Based on the temporary diversion, various parameters associated with hydrocarbon flow may be determined, such as oil flow rate, gas flow rate, water cut, wellhead pressure, and the like. Once tested, the hydrocarbon well is once again tied to a production line. Well testing may be performed over the course of a single day in some situations.

In many cases, the various parameters measured on the single day become the assumed flow rates for the hydrocarbon well over a relatively long period of time, such as three months or a year. That is, the legal entity responsible for the wells in the field may measure total field hydrocarbon flow at a distant location, and then attribute a portion of the total hydrocarbon flow from the field to each well based on the well testing parameters. If changes in hydrocarbon flow take place for a particular well, such changes may not be known, or attribution properly made, until the next well test reveals the change. Historically, the hydrocarbon wells are tested on a rotating basis, roughly in sequential order based on the time since the last well test.

BRIEF DESCRIPTION OF THE DRAWINGS

For a detailed description of exemplary embodiments, reference will now be made to the accompanying drawings in which.

NOTATION AND NOMENCLATURE

Certain terms are used throughout the following description and claims to refer to particular system components. As one skilled in the art will appreciate, different companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection or through an indirect connection.

"Production parameter" shall mean a measured value associated with hydrocarbons flowing from a well. An indication of water simultaneously produced with hydrocarbons shall be considered a production parameter.

"Well test" and "well testing" shall refer to periodic measurement of parameters regarding hydrocarbon flow from a hydrocarbon well, the measurement by portable equipment distinct from measurement equipment permanently or semi-permanently installed at the hydrocarbon well.

DETAILED DESCRIPTION

The following discussion is directed to various embodiments of the invention. Although one or more of these embodiments may be preferred, the embodiments disclosed should not be interpreted, or otherwise used, as limiting the scope of the disclosure or claims. In addition, one skilled in the art will understand that the following description has broad application, and the discussion of any embodiment is meant only to be exemplary of that embodiment, and not intended to intimate that the scope of the disclosure or claims is limited to that embodiment.

At least some of the various embodiments are directed to methods and systems of selecting hydrocarbon wells for well testing. More particularly, at least some embodiments are directed to a computer-implemented selection methodology that takes into account not only the time since the last well test has been performed, but also other parameters that may indicate that the time and money of well testing may be better spent testing a hydrocarbon well that, from merely a time perspective, would not be selected for well testing. The parameters upon which a well testing decision is made may be production parameters, non-production parameters (e.g., parameters measured during a shut in procedure), or parameters associated with other wells not selected for well testing. The specification first turns to an illustrative hydrocarbon producing field to orient the reader to the physical structure at issue, and then to various embodiments of selecting hydrocarbon wells for testing.

Figure 1:
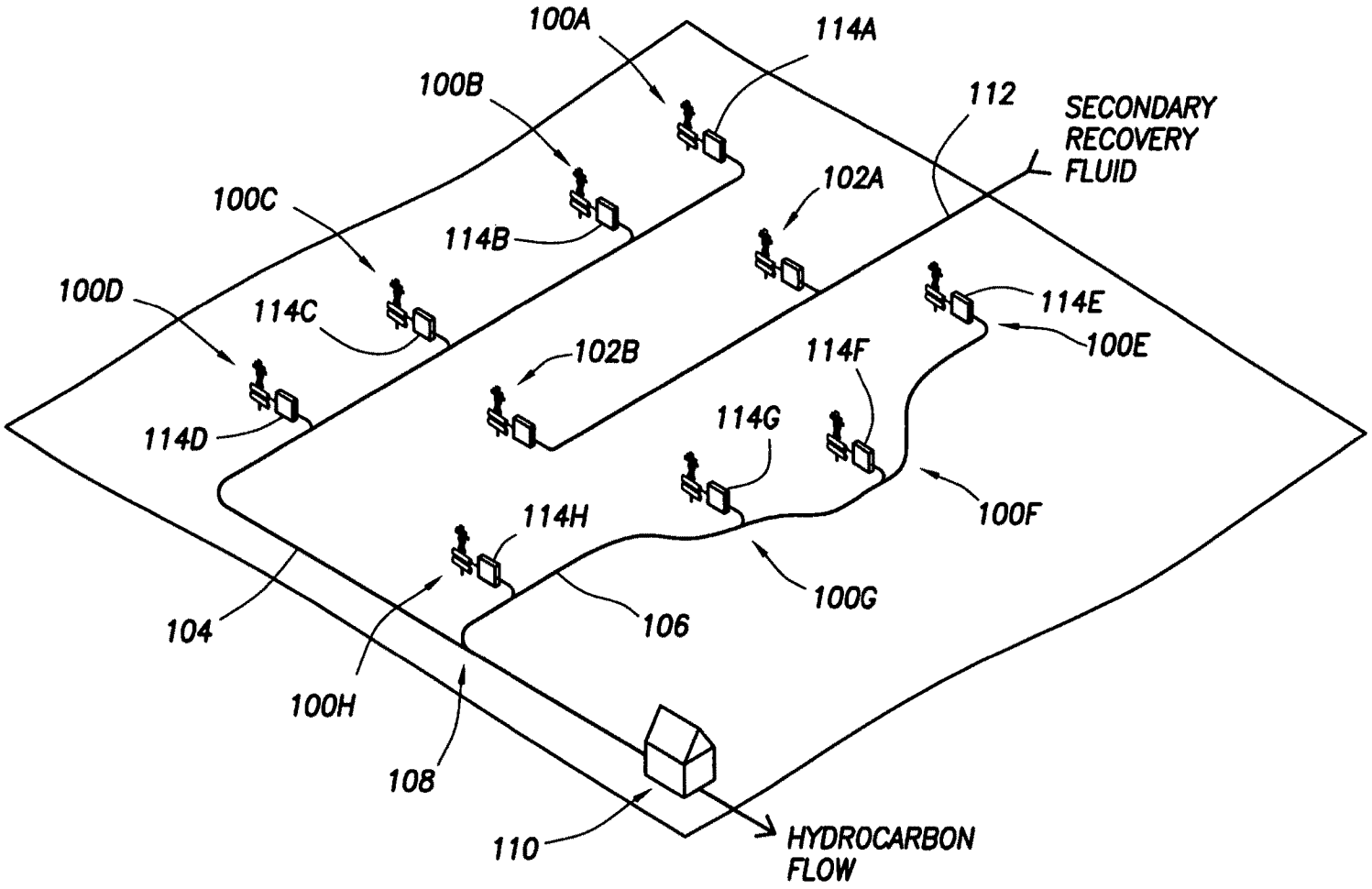
FIG. 1 shows a perspective view of a hydrocarbon producing field in accordance with at least some embodiments.

FIG. 1 shows a perspective view of a hydrocarbon producing field in accordance with at least some embodiments. In particular, the hydrocarbon producing field comprises a plurality of wellbores. Some wellbores are wellbores out which hydrocarbons flow (i.e., hydrocarbon wells), and other wellbores are used for injection of secondary recovery fluids, such as water or compressed carbon dioxide (i.e., injection wells). In the illustrative case of FIG. 1, wellbores 100 (labeled 100A through 100H) are hydrocarbon wells, and wellbores 102 (labeled 102A and 102B) are injection wells. The location of each wellbore is symbolized in the FIG. 1 by a valve stack, sometimes referred to as a "Christmas tree" in the industry, based primarily on its shape. The location of each wellbore may seem random when viewed from above, but in most cases has a layout to increase the extraction of hydrocarbon from the underlying formation (not shown in FIG. 1).

In order to gather the produced hydrocarbons for sale, the hydrocarbon field has one more production flow lines (sometimes "production line"). In FIG. 1, production line 104 gathers hydrocarbons from illustrative hydrocarbon wells 100A-100D, and production line 106 gathers hydrocarbons from illustrative hydrocarbon wells 100E-100G. The production lines 104 and 106 tie together at point 108, and then flow to a metering facility 110.

In some cases, the secondary recovery fluid is delivered to the injection wells by way of trucks, and thus the secondary recovery fluid may only be pumped into the formation on a period basis (e.g., daily, weekly). In other embodiments, and as illustrated, the second recovery fluid is provided under pressure to the injection wells 102A and 102B by way of pipes 112.

The hydrocarbon producing field of FIG. 1 illustratively has eight hydrocarbon wells, and two injection wells; however, the number of wells is merely illustrative. In practice, a hydrocarbon producing field may have many tens or even hundreds of wellbores to be managed. The illustration of FIG. 1 is presented with a limited number of wellbores so as not to unduly complicate the figure and the discussion, but such should not be read as a limitation as the applicability of the various embodiments.

In accordance with at least some embodiments, each hydrocarbon well 100 has at least one, and in some cases more than one, measurement device for measuring parameters associated with the hydrocarbon production. FIG. 1 illustrates the measurement devices as devices 114A-114H associated one each with each hydrocarbon well 100A-100H. The measurement devices may take many forms, and the measurement devices need not be the same across all the hydrocarbon wells 100. In some cases, the measurement device may be related to the type of lift employed (e.g., electric submersible, gas lift, pump jack). In other cases, the measurement device on a hydrocarbon well may be selected based on a particular quality of hydrocarbons produced, such as a tendency to produce excess water. With idea in mind that many variations on the selection of measurement devices are possible, even for similarly situated wells, the specification now turns to an example list of such devices.

In some cases, one or more of the measurement devices 114 may be a multi-phase flow meter. A multi-phase flow meter has the ability to not only measured hydrocarbon flow from a volume standpoint, but also give an indication of the mixture of oil and gas in the flow. One or more of the measurement devices may be oil flow meters, having the ability to discern oil flow, but not necessarily natural gas flow. One or more of the measurement devices may be natural gas flow meters. One or more of the measurement devices may be water flow meters. One or more of the measurement devices may be pressure transmitters measuring the pressure at any suitable location, such as at the wellhead, or within the borehole near the perforations. In the case of measurement devices associated with the lift provided, the measurement devices may be voltage measurement devices, electrical current measurement devices, pressure transmitters measuring gas lift pressure, frequency meter for measuring frequency of applied voltage to electric submersible motor coupled to a pump, and the like. Moreover, multiple measurement devices may be present on any one hydrocarbon producing well. For example, a well where artificial lift is provided by an electric submersible may have various devices for measuring hydrocarbon flow at the surface, and also various devices for measuring performance of the submersible motor and/or pump. As another example, a well where artificial lift is provided by a gas lift system may have various devices for measuring hydrocarbon flow at the surface, and also various measurement devices for measuring performance of the gas lift system.

Figure 2:
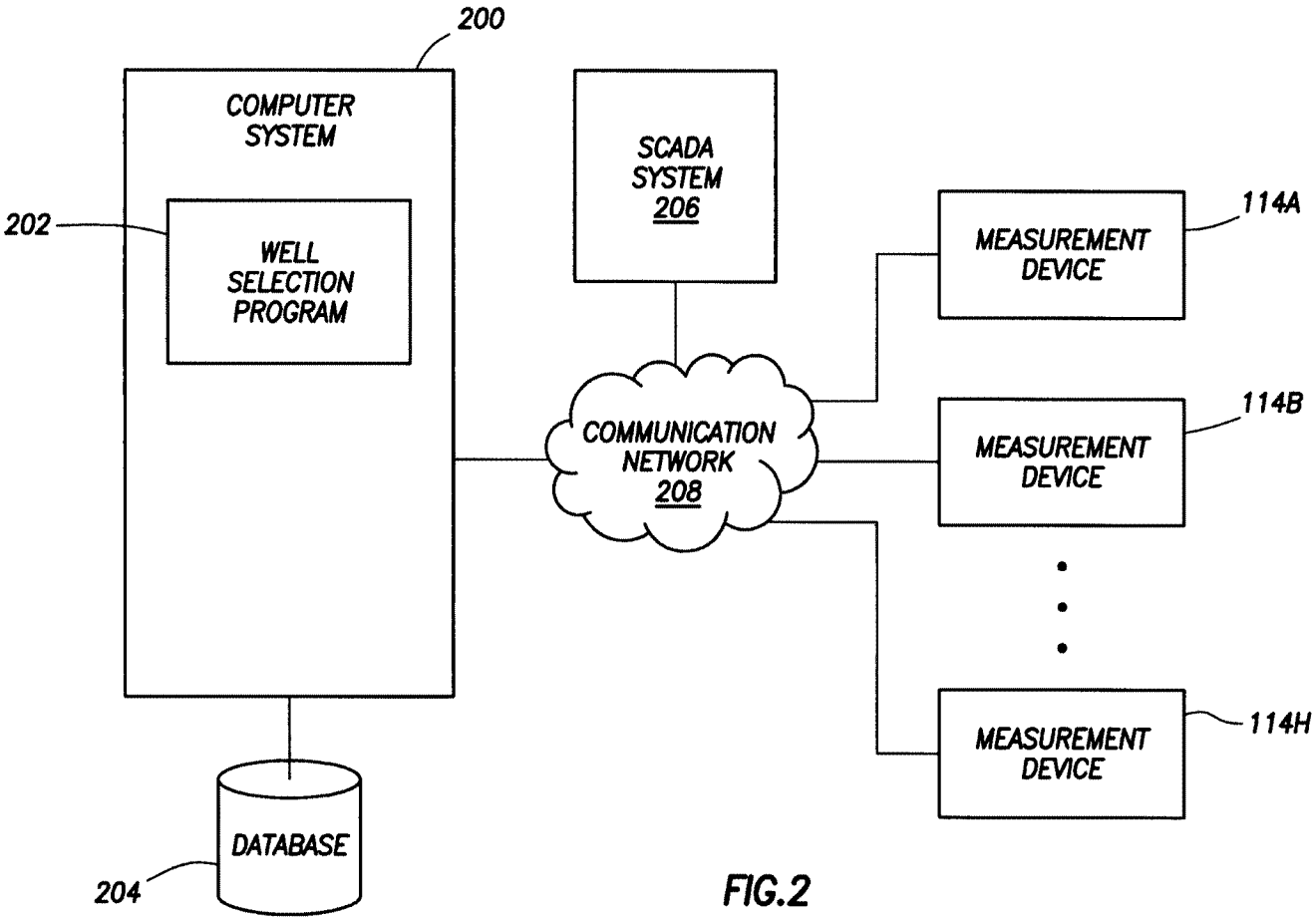
FIG. 2 shows a block diagram of a system in accordance with at least some embodiments.

FIG. 2 shows a block diagram of system in accordance with at least some embodiments. In particular, the system comprises a computer system 200 upon which one or more programs are executed. The computer system may take any suitable form. In some cases, the computer system 200 is a server computer system located at a data center associated with the hydrocarbon producing field. The data center may be physically located on or near the field, or the data center may be many hundreds or thousand of miles from the hydrocarbon producing field. In other cases, computer system 200 may be a laptop or desktop computer system. In yet still other cases, the computer system 200 may be a conglomeration of computer devices, such as portable devices communicatively coupled to other computer systems. Further still, the computer system 200 may be "cloud" computer systems, such that the precise location of the computer systems is not known to the user, or may change based on the computer load presented.

Regardless of the precise nature of the computer system 200, the computer system executes one or more programs that identify hydrocarbon wells for well testing, the one or more programs illustrated as well selection program 202. Well selection program 202 makes decisions and/or recommendations on which wells to subject to well testing based on a variety of information. The information upon which decisions and/or recommendations are made may be historical information, such as stored in a database 204 coupled to the computer system 200. The information upon which decisions and/or recommendations are made may come from a supervisory control and data acquisition (SCADA) system 206 (which SCADA system itself may implement a database of historical values), coupled to the computer system 200 by way of a communication network 208. The information upon which decisions and/or recommendations are made may come directly to the computer system 200 from the measurement devices 114 themselves, coupled to the computer system 200 by way of the communication network 208. In some cases, the information upon which decisions and/or recommendations are made may come from multiple of the illustrative sources.

The communication network 208 may take any suitable form. In some cases, the communication network 208 is a dedicated local- or wide-area network to which the various devices are coupled. In other cases, the communication network may involve in whole or in part the Internet, such as a virtual private network (VPN) carried over the Internet. From a hardware stand point the communication network may involve electrical conductors, optical conductors, radio frequency electromagnetic wave signals propagated point-to-point, and/or satellite based communication.

Figure 3:
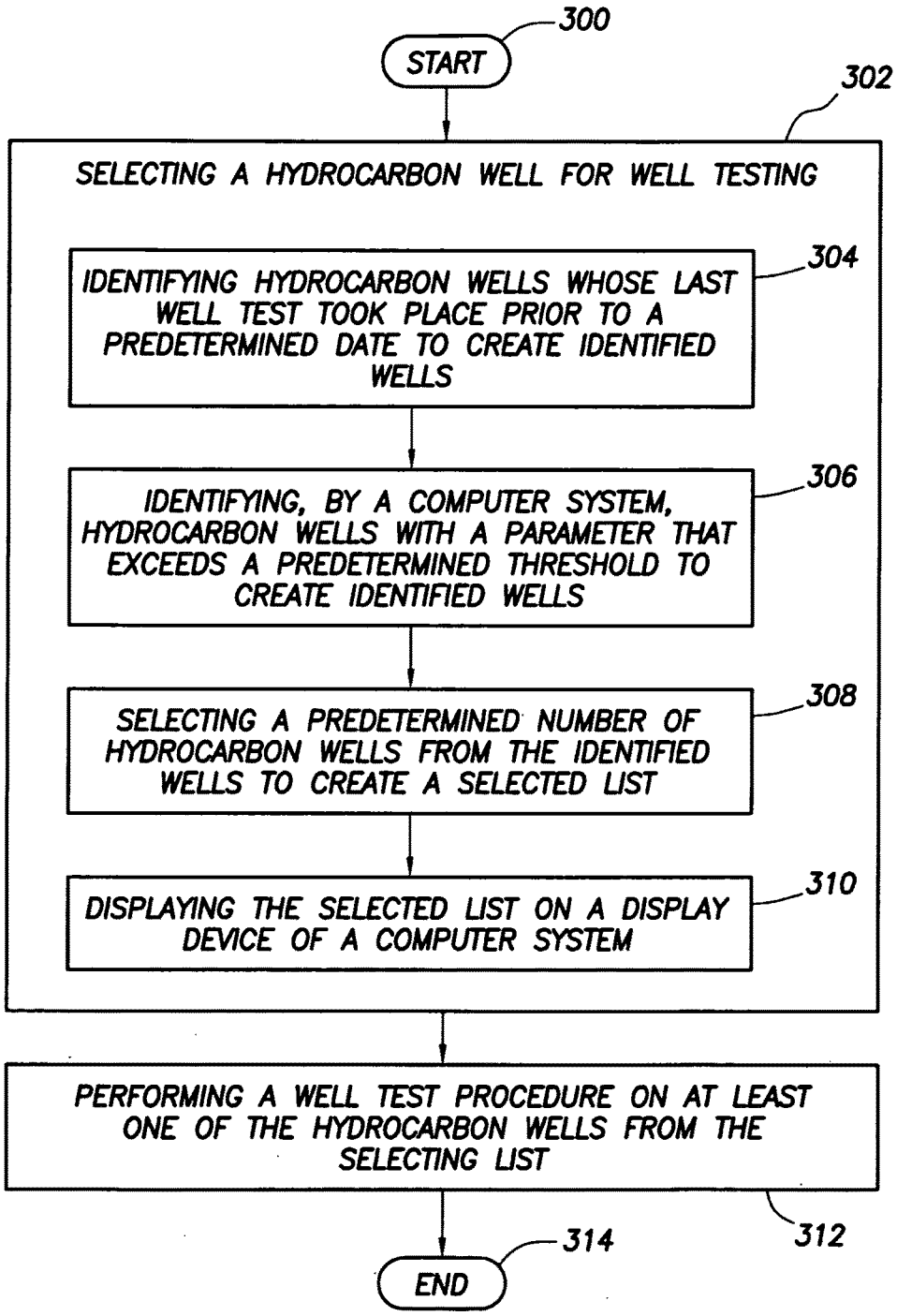
FIG. 3 shows a method in accordance with at least some embodiments.

Regardless of the type of communication network used, the computer system communicates with one or more devices and selects a predetermined number of hydrocarbon wells to recommend for well testing. FIG. 3 shows a method in accordance with at least some embodiments, and some of the illustrative steps may be performed by way of a computer program. In particular, the method starts (block 300) and proceeds to selecting a hydrocarbon well for testing (block 302). The selection of the hydrocarbon well for well testing may illustrative involve identifying hydrocarbon wells whose last well test took place prior to a predetermined date to create identified wells (block 304). In some cases the identifying based on the last well test is a Boolean operation—all hydrocarbon wells whose last well test was prior to the predetermined date are added to the identified wells list. In other cases, hydrocarbon wells that meet the date criteria may nevertheless be excluded. For example, hydrocarbon wells that have been plugged or shut in may technically meet the data criteria, but may be excluded from the identified list. Again, the predetermined date criteria may be any suitable period of time at the discretion of the operator of the hydrocarbon field. In some cases the predetermined date is more than one year from the current date. In yet still other embodiments, the predetermined date may be more than 60 days from the current date, or more than 30 days from the current date.

The illustrative method further comprises identifying hydrocarbon wells with a parameter that meets or exceeds a predetermined threshold to create further identified wells (block 306). The parameter tested may be a production parameter, and may take many forms. For example, the production parameter may be a change in hydrocarbon production volume (e.g., unexplained production loss greater than 5%, or unexplained production gain greater than 5%). As another example, the production parameter may be a predetermined change in water cut (e.g., unexplained water cut increase greater than 5%, or unexplained water cut decrease greater than 5%). Other examples of the production parameter include: wellhead pressure change; bottom hole pressure change; unexplained change in electrical current draw on a submersible pump; unexplained change in gas lift pressure for a gas lift wells; or temperature of hydrocarbons produced. Any measurable production parameter may form the basis of identifying wells for the identified wells list, and thus the illustrative examples shall not be viewed as a limitation as to the applicability.

Moreover, the identifying wells based on production parameters need not be limited to production parameters for the particular well ultimately placed on the identified list. For example, production parameters of nearby wells may form the basis. For example, if a particular hydrocarbon well under scrutiny has experienced no change in production parameters, yet surrounding wells have experienced a change (e.g., decreased hydrocarbon flow, decreased pressure, increased water cut), then such a lack of change of a production parameter may be indicative of a problem that dictates well testing.

Further still, selection of a hydrocarbon well for the identified list may be based on parameters associated with the hydrocarbons, but not while the hydrocarbons are flowing to the production line. For example, hydrocarbon wells are from time-to-time shut in. For example, a downstream compressor may fail, or the gas processing facility goes offline. During periods of time when the hydrocarbon well is shut in various parameters may still be measured by the measurement devices. For example, wellhead pressure may be measured during a shut in, and downhole pressure may be measured during a shut in. Values of parameters measured during shut in that our outside an expected range may also be a criteria for adding a hydrocarbon well to the identified list.

Yet further still, selection of a hydrocarbon well for the identified list may be based on parameters associated with a prior well test. For example, if during a prior well test a high degree of variability as to the instantaneous water cut is noted, such may indicate flow potential increases in water cut in the near future.

Regardless of the parameters used to create the identified wells, a predetermined number of hydrocarbon wells are selected to create a selected list (block 308). The selection of hydrocarbon wells from the identified wells may take many forms. For example, the selection may need to choose between a hydrocarbon well that has just recently moved beyond the predetermined time from the last well test, and a second hydrocarbon well whose predetermined time has not yet expired, but because of a change in a production or other parameter, was designated as identified. The precise nature of how to choose between hydrocarbon wells that have been identified may be based on operator or regulatory specific guidelines. In the illustrative example given in this paragraph, the program may choose the hydrocarbon wells whose production parameters indicate a substantial change in flow over a hydrocarbon well whose time since the last well test has expired, but whose production parameters indicate that the hydrocarbon well is functioning as expected. As another example, for identified wells identified based on loss of production over a predetermined threshold (e.g., production loss greater than 5%), wells may be selected based on the magnitude of the production loss. As another example, for identified wells all identified based on increased water cut (e.g., water cut growing greater than 5%), the identified wells may be selected based on the hydrocarbon wells showing the greatest water cut increase.

In some embodiments, the selection of hydrocarbon wells (again block 308) also has a number component. That is, in narrowing or selecting from the identified wells, the narrowing or selecting may be to select a predetermined number of hydrocarbon wells (e.g., seven hydrocarbon wells, ten hydrocarbon wells). The predetermined number may be based on several factors. For example, if the hydrocarbon producing field has only one mobile well testing unit, seven hydrocarbon producing wells may be selected representing the wells to be tested over the next seven days. As another example, if the hydrocarbon producing field has 10 mobile well testing units, 10 hydrocarbon wells may be selected representing the wells to be tested that day.

After selecting wells for the selected list, the selected list may be displayed on a display device of a computer system (block 310). From the selected list, a production engineer may choose one or more wells for well testing from the selected list, and then have the well testing performed (block 312). The method may thereafter end (block 314), possibly to be restarted (e.g., the next day).

In some cases, each well not specifically excluded is assigned a value indicative of the need to perform well testing, termed herein a well test priority index. The well test priority index may take many forms, but in a particular embodiment has three components: lapsed time component; a production loss/gain component; and water cut increase/decrease component. For example, the lapsed time component may be calculated using the following illustrative equation:

$$NLP[\%] = \frac{\text{ACTUAL_LAPSED_TIME_[days]}}{\text{MAX_LAPSED_TIME_[days]}} \times 100 \quad (1)$$

Where NLP is the normalized lapsed time, ACTUAL_LAPSED_TIME is the number of days since the last well test, and MAX_LAPSED_TIME is the predetermined time span between well test procedures (e.g., 1 year, six months, three months).

The production loss/gain component of the well test priority index may be calculated using the following illustrative equation:

$$NPL[\%] = \frac{\text{ACTUAL_PRODUCTION_LOSS_[k_stb]}}{\text{MAX_PRODUCTION_LOSS_[k_stb]}} \times 100 \quad (2)$$

Where NPL is the normalized production losses, ACTUAL_PRODUCTION_LOSS is the amount of production loss (illustratively in thousands of standard barrels per day), and MAX_PRODUCTION_LOSS is the production goal for the well (illustratively in thousands of standard barrels per day).

The water cut increase/decrease component of the well test priority index may be calculated using the following illustrative equation:

$$NWC[\%] = \frac{\text{ACTUAL_WATER_CUT_INCREASE_[\%]}}{\text{MAX_WATER_CUT_INCREASE_[\%]}} \times 100 \quad (3)$$

Where NWC is the normalized water cut increase, ACTUAL_WATER_CUT_INCREASE is the amount of water cut increase, and MAX_WATER_CUT_INCREASE is the water expected water production for the well The illustrative well test priority index may then be calculated by combining the various values calculated according to the equations, where each value is weighted between 0.1 and 2.0, and more particularly between 1.0 and 1.75. For example, the well test priority index may be calculated using the following illustrative equation:

$$WTP=(NLP\times WF1)\times(NPL\times WF2))\times(NWC\times WF3)) \quad (4)$$

Where WTP is the well test priority index, WF1 is the weight factor for NLP (e.g., 1.0), WF2 is the weight factor for NPL (e.g., 1.25), and WF3 is the weight factor for NWC (e.g., 1.75). Other methods to derive the well test priority index may also be used.

Figure 4:
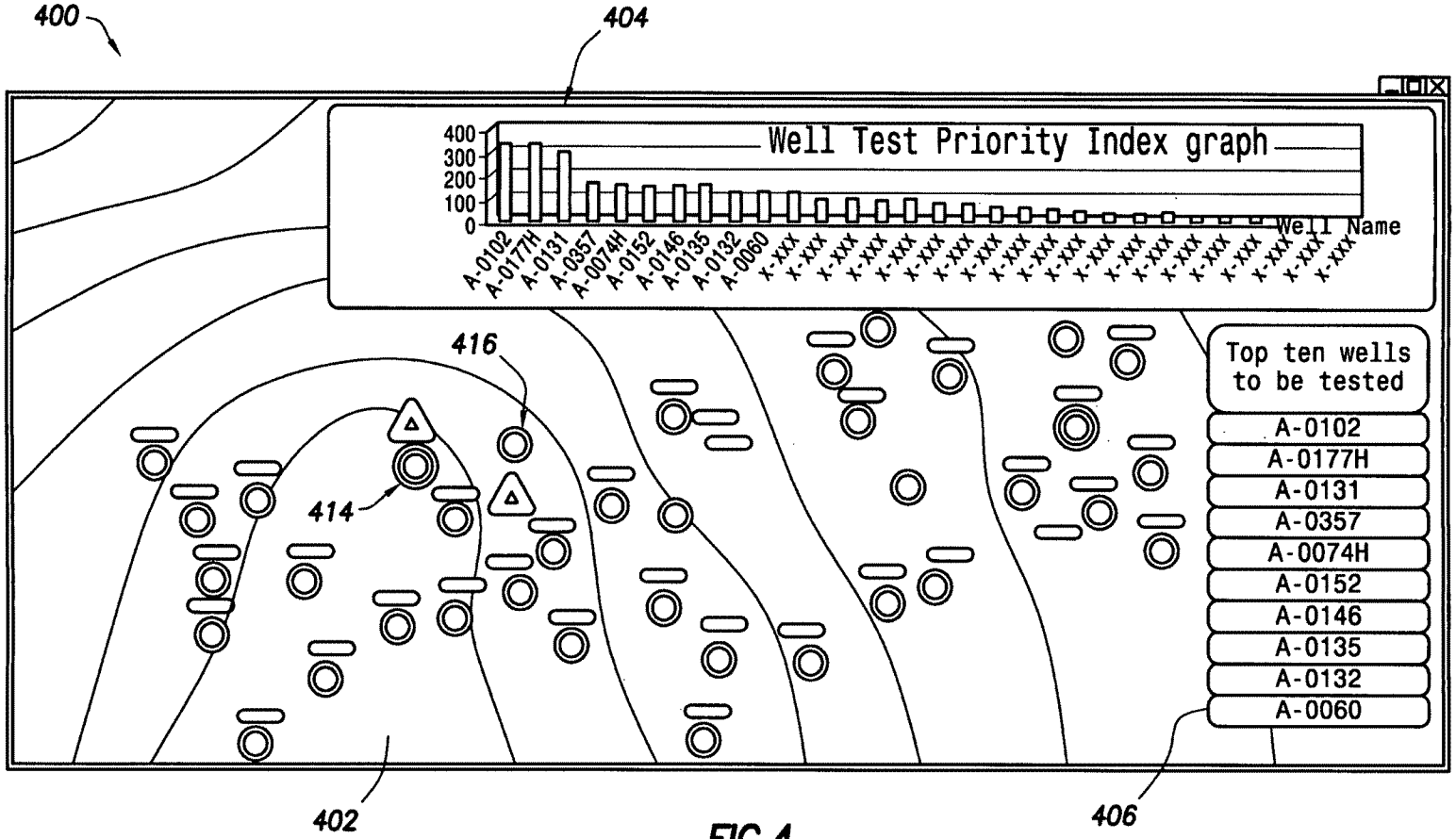
FIG. 4 shows a user interface in accordance with at least some embodiments.

FIG. 4 shows an illustrative user interface 400 window in accordance with at least some embodiments. In particular, the user interface comprises several panes. A first pane 402 shows an overhead view of the hydrocarbon producing field. The first pane 402 is overlaid by a second pane 404, which second pane 404 illustrative shows a list of hydrocarbon producing wells and their respective well test priority index. The user interface 400 further comprises a third pane 406 which shows an illustrative software generated priority list. Each pane will be discussed in turn.

The first pane 402 shows an overhead view of at least a portion of the hydrocarbon field, and thus shows some or all of the hydrocarbon wells in the field. In some cases the first pane may be an actual high altitude picture of the field (e.g., taken by airplane, or taken by satellite), with graphics embedded thereon showing the relative location of each hydrocarbon well. In other cases, the view within the first pane may be a topographical map, again with graphics embedded thereon showing the relative location of each hydrocarbon well. In yet still further cases, the view in the first pane 402 may merely show the relative horizontal location of each hydrocarbon well. Other arrangements are possible.

In accordance with at least some embodiments, each well identified in the illustrative method above may be shown on the second pane 404. In other cases, only the wells on the selected list are shown on the second pane 404. As illustrated, the second pane 404 lists wells along the lower or "x" axis, and the respective value of their well test priority index is plotted against the left or "y" axis.

In some cases, the indicia as to status within the illustrative pane 404 may be reflected in the first pane 402. For example, hydrocarbon well 414 may have an indicia (e.g., a yellow circle) that visually depicts the status of the well as being shown in the second pane 404, and/or the value of the well test priority index. As another example, hydrocarbon well 416 may have an indicia (e.g., a red circle) that visually depicts the status of the well as being shown in the second pane 404, and/or the value of the well test priority index. Having the depictions of the wells in the first pane also reflect the indicia of status in the second pane 404 is merely illustrative, and may be useful in tying the information between the two panes together in the mind of a viewer, but is not strictly required. Third pane 406 illustrative shows hydrocarbon wells on the selected list, and ranked according to priority as perceived by the well selection program 202.

In some cases, when a hydrocarbon well resides on the list in pane 406, an indicia as to the wells presence in pane 406 may be reflected in the first pane 402. For example, hydrocarbon well 414 may have an indicia (e.g., a triangle plotted proximate to the location of the well) that visually depicts the status of the well as being present in the third pane 406. As another example, hydrocarbon well 416 may have an indicia (e.g., again a triangle plotted proximate to the location of the well) that visually depicts the status of the well as being present in the third pane 406. Having the depictions of the wells in the first pane 402 also reflect the indicia of status in the third pane 406 is merely illustrative, and may be useful in tying the information between the two panes together in the mind of a viewer, but is not strictly required.

Figure 5:
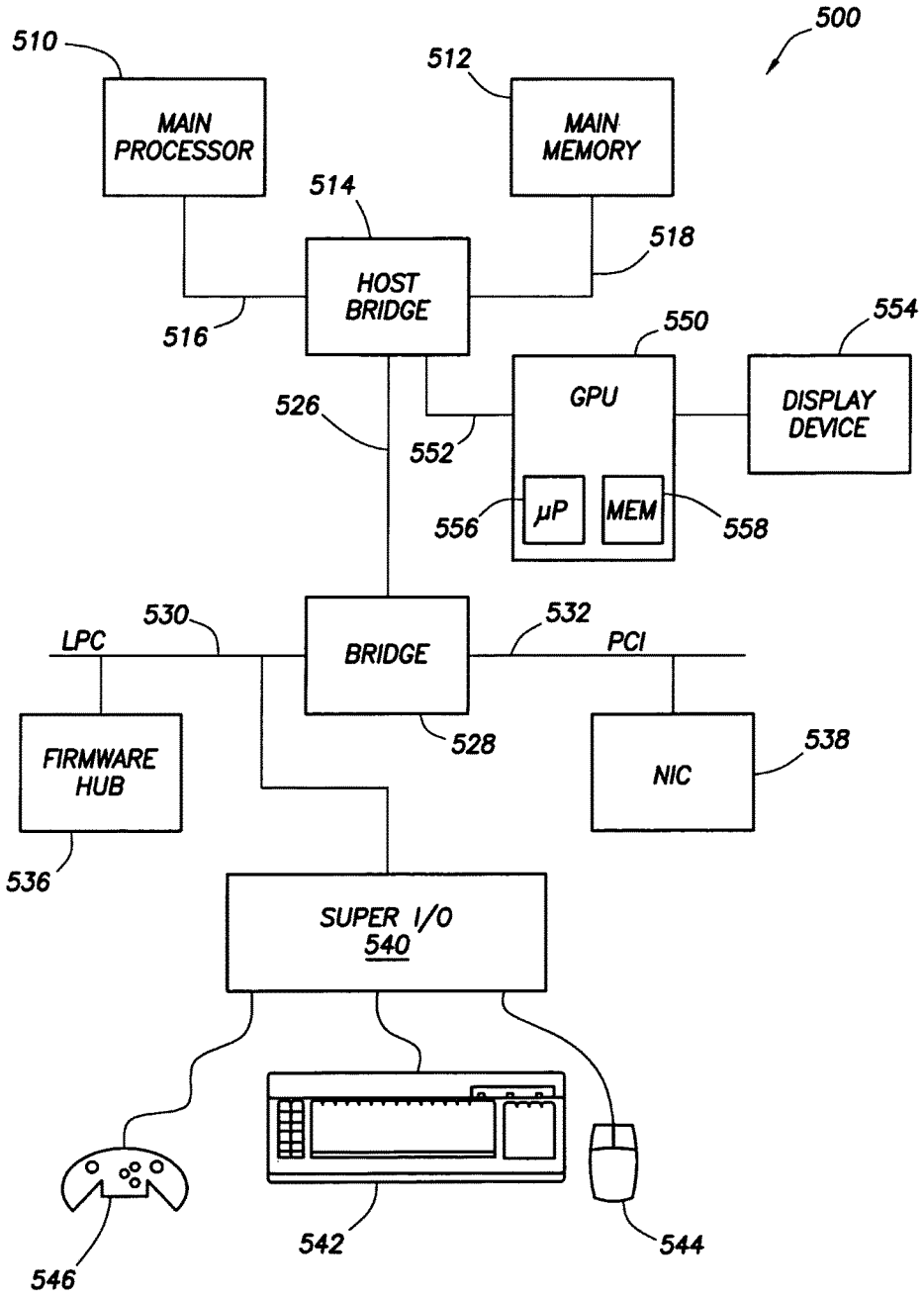
FIG. 5 shows a block diagram of a computer system in accordance with at least some embodiments.

FIG. 5 illustrates a computer system 500 in accordance with at least some embodiments. Any or all of the embodiments that involve identifying hydrocarbon wells, selecting hydrocarbon wells, displaying selected wells, and/or displaying of user interfaces may be implemented in whole or in part on a computer system such as that shown in FIG. 5, or after-developed computer systems. In particular, computer system 500 comprises a main processor 510 coupled to a main memory array 512, and various other peripheral computer system components, through integrated host bridge 514. The main processor 510 may be a single processor core device, or a processor implementing multiple processor cores. Furthermore, computer system 500 may implement multiple main processors 510. The main processor 510 couples to the host bridge 514 by way of a host bus 516, or the host bridge 514 may be integrated into the main processor 510. Thus, the computer system 500 may implement other bus configurations or bus-bridges in addition to, or in place of, those shown in FIG. 5.

The main memory 512 couples to the host bridge 514 through a memory bus 518. Thus, the host bridge 514 comprises a memory control unit that controls transactions to the main memory 512 by asserting control signals for memory accesses. In other embodiments, the main processor 510 directly implements a memory control unit, and the main memory 512 may couple directly to the main processor 510. The main memory 512 functions as the working memory for the main processor 510 and comprises a memory device or array of memory devices in which programs, instructions and data are stored. The main memory 512 may comprise any suitable type of memory such as dynamic random access memory (DRAM) or any of the various types of DRAM devices such as synchronous DRAM (SDRAM), extended data output DRAM (EDO-DRAM), or Rambus DRAM (RDRAM). The main memory 512 is an example of a non-transitory computer-readable medium storing programs and instructions, and other examples are disk drives and flash memory devices.

The illustrative computer system 500 also comprises a second bridge 528 that bridges the primary expansion bus 526 to various secondary expansion buses, such as a low pin count (LPC) bus 530 and peripheral components interconnect (PCI) bus 532. Various other secondary expansion buses may be supported by the bridge device 528.

Firmware hub 536 couples to the bridge device 528 by way of the LPC bus 530. The firmware hub 536 comprises read-only memory (ROM) which contains software programs executable by the main processor 510. The software programs comprise programs executed during and just after power on self test (POST) procedures as well as memory reference code. The POST procedures and memory reference code perform various functions within the computer system before control of the computer system is turned over to the operating system. The computer system 500 further comprises a network interface card (NIC) 538 illustratively coupled to the PCI bus 532. The NIC 538 acts to couple the computer system 500 to a communication network, such the Internet, or local- or wide-area networks.

Still referring to FIG. 5, computer system 500 may further comprise a super input/output (I/O) controller 540 coupled to the bridge 528 by way of the LPC bus 530. The Super I/O controller 540 controls many computer system functions, for example interfacing with various input and output devices such as a keyboard 542, a pointing device 544 (e.g., mouse), a pointing device in the form of a game controller 546, various serial ports, floppy drives and disk drives. The super I/O controller 540 is often referred to as "super" because of the many I/O functions it performs.

The computer system 500 may further comprise a graphics processing unit (GPU) 550 coupled to the host bridge 514 by way of bus 552, such as a PCI Express (PCI-E) bus or Advanced Graphics Processing (AGP) bus. Other bus systems, including after-developed bus systems, may be equivalently used. Moreover, the graphics processing unit 550 may alternatively couple to the primary expansion bus 526, or one of the secondary expansion buses (e.g., PCI bus 532). The graphics processing unit 550 couples to a display device 554 which may comprise any suitable electronic display device upon which any image or text can be plotted and/or displayed. The graphics processing unit 550 may comprise an onboard processor 556, as well as onboard memory 558. The processor 556 may thus perform graphics processing, as commanded by the main processor 510. Moreover, the memory 558 may be significant, on the order of several hundred megabytes or more. Thus, once commanded by the main processor 510, the graphics processing unit 550 may perform significant calculations regarding graphics to be displayed on the display device, and ultimately display such graphics, without further input or assistance of the main processor 510.

In the specification and claims, certain components may be described in terms of algorithms and/or steps performed by a software application that may be provided on a non-transitory storage medium (i.e., other than a carrier wave or a signal propagating along a conductor). The various embodiments also relate to a system for performing various steps and operations as described herein. This system may be a specially-constructed device such as an electronic device, or it may include one or more general-purpose computers that can follow software instructions to perform the steps described herein. Multiple computers can be networked to perform such functions. Software instructions may be stored in any computer readable storage medium, such as for example, magnetic or optical disks, cards, memory, and the like.

At least some embodiments are methods comprising: selecting a hydrocarbon well for well testing; and performing a well test procedure on at least one of the hydrocarbon wells from the selected list. The selecting may be by: identifying, by a computer system, hydrocarbon wells whose last well test took place prior to a predetermined date to create identified wells; identifying, by a computer system, hydrocarbon wells with a parameter that exceeds a predetermined threshold to create identified wells; and selecting a predetermined number of hydrocarbon wells from the identified wells to create a selected list.

The selecting may further comprise selecting based on a parameter measured during a prior well test. The selecting may further comprise selecting based on a parameter measured during a period of time a when at least one hydrocarbon well was shut in. The selecting may further comprise selecting based on a production parameter of a hydrocarbon well not on the selected list.

The example method may further comprise: displaying on a display device of a computer system an overhead view of a spatial layout a plurality of hydrocarbon producing wells; and for each hydrocarbon well on the selected list visible on the display displaying an indicia that the hydrocarbon well is on the selected list. The method may further comprise, for each hydrocarbon well visible on the display device, displaying an indicia of the state of hydrocarbon production. The method may further comprise, for each hydrocarbon well on the selected list visible on the display, displaying an indicia of a reason why the hydrocarbon well is on the selected list.

Other example embodiments are systems comprising: a plurality of hydrocarbon producing wells; a plurality of measurement devices associated one each with each of the plurality of hydrocarbon producing wells, each measurement device measures at least one parameter associated with hydrocarbon flow; and a computer system communicatively coupled to the plurality of measurement devices, the computer system comprising a processor and a memory coupled to the processor. The memory stores a program that causes the processor to: identify hydrocarbon wells whose last well test took place prior to a predetermined date to create identified wells; identify hydrocarbon wells with a production parameter that exceeds a predetermined threshold to create identified wells; select a predetermined number of hydrocarbon wells from the identified wells to create a selected list; and display an indication of the hydrocarbon wells on the selected list on a display device coupled to the processor.

In the example system, each of the plurality of measurement devices measure at least one parameter selected from the group consisting of: total flow volume; oil flow; natural gas flow; water flow; water cut; and pressure of the hydrocarbon flow proximate a wellhead.

In a further example system, when the processor selects, the program further causes the processor to select based on a parameter measured during a prior well test. In yet another example system, when the processor selects, the program further causes the processor to select based on a parameter measured during a period of time a when at least one hydrocarbon well was shut in. In yet still another example system, when the processor selects, the program further causes the processor to select based on a production parameter of a hydrocarbon well not on the selected list.

In further example systems, when the processor displays, the program further causes the processor to: display on the display device an overhead view of a spatial layout a plurality of hydrocarbon producing wells; (and for each hydrocarbon well on the selected list visible on the display) display an indicia that the hydrocarbon well is on the selected list. In yet further example systems, when the processor displays the indicia, the program further causes the processor to, for each hydrocarbon well visible on the display device, display an indicia of the state of hydrocarbon production. In yet still further example systems, when the processor displays the indicia, the program further causes the processor to, for each hydrocarbon well visible on the display device, displaying an indicia of a reason why the hydrocarbon well is on the selected list.

Yet still further embodiments are non-transitory computer-readable mediums storing a program that, when executed by a processor, causes the processor to: identify hydrocarbon wells whose last well test took place prior to a predetermined date to create identified wells; identify hydrocarbon wells with a production parameter that exceeds a predetermined threshold to create identified wells; select a predetermined number of hydrocarbon wells from the identified wells to create a selected list; and display an indication of the hydrocarbon wells on the selected list on a display device coupled to the processor, wherein the indication of hydrocarbon wells on the selected list provides a ranking.

In yet further example computer-readable mediums, when the processor selects, the program further causes the processor to select based on a parameter measured during a prior well test. In yet still further example computer-readable mediums, when the processor selects, the program further causes the processor to select based on a parameter measured during a period of time a when at least one hydrocarbon well was shut in. In yet still further example computer-readable mediums, when the processor selects, the program further causes the processor to select based on a production parameter of a hydrocarbon well not on the selected list.

In yet still further example computer-readable mediums, when the processor displays, the program further causes the processor to: display on the display device an overhead view of a spatial layout a plurality of hydrocarbon producing wells; (and for each hydrocarbon well on the selected list visible on the display) display an indicia that the hydrocarbon well is on the selected list. The programs may further cause the processor to: for each hydrocarbon well visible on the display device, display an indicia of the state of hydrocarbon production; and for each hydrocarbon well visible on the display device, displaying an indicia of a reason why the hydrocarbon well is on the selected list.

References to "one embodiment", "an embodiment", "a particular embodiment" indicate that a particular element or characteristic is included in at least one embodiment of the invention. Although the phrases "in one embodiment", "an embodiment", and "a particular embodiment" may appear in various places, these do not necessarily refer to the same embodiment.

From the description provided herein, those skilled in the art are readily able to combine software created as described with appropriate general-purpose or special-purpose computer hardware to create a computer system and/or computer sub-components in accordance with the various embodiments, to create a computer system and/or computer sub-components for carrying out the methods of the various embodiments and/or to create a non-transitory computer-readable media (i.e., not a carrier wave) that stores a software program to implement the method aspects of the various embodiments.

The above discussion is meant to be illustrative of the principles and various embodiments of the present invention. Numerous variations and modifications will become apparent to those skilled in the art once the above disclosure is fully appreciated. For example, a separate list need not be created for the identified wells and/or the selected wells; rather, the inclusion as identified or an a selected list may merely be a notation within field of a file containing an indication of all the hydrocarbon wells of the field. It is intended that the following claims be interpreted to embrace all such variations and modifications.

What is claimed is:

1. A method comprising:

acquiring, by a computer system from a data source via a communication network, information about well tests performed on a plurality of hydrocarbon wells tied to one or more production lines within a hydrocarbon producing field;

calculating a first value indicative of an amount of lapsed time since a prior well test was performed for each of the plurality of hydrocarbon wells, based on the acquired information;

obtaining, by the computer system via the communication network from measurement devices coupled to each of the plurality of hydrocarbon wells, measurements of at least one parameter for each of the plurality of hydrocarbon wells;

calculating at least one second value indicative of a change in the at least one parameter for each of the plurality of hydrocarbon wells, based in part on the measurements obtained from the measurements devices coupled to that hydrocarbon well;

determining a well test priority index for each of the plurality of hydrocarbon wells, based on the first and second values calculated for that hydrocarbon well;

assigning the corresponding well test priority index to each hydrocarbon well in the plurality of hydrocarbon wells;

selecting, by the computer system, a predetermined number of hydrocarbon wells from the plurality of hydrocarbon wells to create a list of selected wells, based on the well test priority index assigned to each hydrocarbon well; and performing, by a mobile well testing unit associated with each of the hydrocarbon wells in the list of selected wells, a well test by:

diverting hydrocarbon flow from the associated hydrocarbon well through well testing equipment of the mobile well testing unit before flowing into the one or more production lines;

measuring parameters associated with the diverted hydrocarbon flow; and determining whether the associated hydrocarbon well is functioning as expected, based on the measured parameters, wherein each hydrocarbon well in the list of selected wells is once again tied to the one or more production lines following the well test of that hydrocarbon well.

2. The method of claim 1 wherein the list of selected wells includes at least one hydrocarbon well for which the amount of lapsed time since the at least one hydrocarbon well's prior well test is more than a predetermined period of time.

3. The method of claim 1 wherein the measurements obtained for at least one of the plurality of hydrocarbon wells include measurements of the at least one parameter obtained during a period of time when the at least one hydrocarbon well was shut in.

4. The method of claim 1 wherein the list of selected wells further includes at least one hydrocarbon well that is selected from the plurality of hydrocarbon wells based on a change in the at least one parameter of a nearby hydrocarbon well.

5. The method of claim 1 wherein the at least one parameter is a production parameter, and the list of selected wells includes at least one hydrocarbon well for which a change in the at least one production parameter exceeds a predetermined threshold.

6. The method of claim 1 further comprising:

displaying on a display device of the computer system an overhead view of a spatial layout of the plurality of hydrocarbon wells; and displaying, for each hydrocarbon well on the list of selected wells that is visible within the overhead view on the display device, an indicia that the hydrocarbon well is on the list of selected wells.

7. The method of claim 6 further comprising, for each hydrocarbon well visible on the display device, displaying an indicia of a state of hydrocarbon production associated with the hydrocarbon well.

8. The method of claim 6 further comprising, for each hydrocarbon well on the list of selected wells visible on the display, displaying an indicia of a reason why the hydrocarbon well is on the list of selected wells.

9. A system comprising:

a plurality of hydrocarbon wells tied to one or more production lines within a hydrocarbon producing field;

a plurality of measurement devices coupled to each of the plurality of hydrocarbon wells, each measurement device measures at least one parameter associated with hydrocarbon flow; and a computer system communicatively coupled to the plurality of measurement devices, the computer system comprising a processor and a memory coupled to the processor, the memory stores a program that, when executed by the processor, causes the processor to:

acquire, from a data source via a communication network, information about well tests performed on the plurality of hydrocarbon wells;

calculate a first value indicative of an amount of lapsed time since a prior well test was performed for each of the plurality of hydrocarbon wells, based on the acquired information;

obtain, via the communication network from the plurality of measurement devices coupled to each of the plurality of hydrocarbon wells, measurements of at least one parameter for each of the plurality of hydrocarbon wells;

calculate at least one second value indicative of a change in the at least one parameter for each of the plurality of hydrocarbon wells, based in part on the measurements obtained from the measurements devices coupled to that hydrocarbon well;

determine a well test priority index for each of the plurality of hydrocarbon wells based on the first and second values calculated for that hydrocarbon well;

assign the corresponding well test priority index to each hydrocarbon well in the plurality of hydrocarbon wells;

select a predetermined number of hydrocarbon wells from the plurality of hydrocarbon wells to create a list of selected wells; and display an indication of the hydrocarbon wells on the list of selected wells on a display device coupled to the processor, wherein a well test of each of the hydrocarbon wells in the list of selected wells is performed by:

diverting hydrocarbon flow from the hydrocarbon well through well testing equipment before flowing into the one or more production lines;

measuring parameters associated with the diverted hydrocarbon flow; and determining whether that hydrocarbon well is functioning as expected, based on the measured parameters, and wherein each hydrocarbon well in the list of selected wells is once again tied to the one or more production lines following the well test of that hydrocarbon well.

10. The system of claim 9 wherein the at least one parameter is selected from the group consisting of: total flow volume; oil flow; natural gas flow; water flow; water cut; and pressure of the hydrocarbon flow proximate a wellhead.

11. The system of claim 9 wherein the measurements obtained for at least one of the plurality of hydrocarbon wells include measurements of the at least one parameter obtained during a prior well test.

12. The system of claim 9 wherein the measurements obtained for at least one of the plurality of hydrocarbon wells include measurements of the at least one parameter obtained during a period of time when the at least one hydrocarbon well was shut in.

13. The system of claim 9 wherein the list of selected wells further includes at least one hydrocarbon well that is selected from the plurality of hydrocarbon wells based on a change in the at least one parameter of a nearby hydrocarbon well.

14. The system of claim 9 wherein when the processor displays, the program further causes the processor to:

display on the display device an overhead view of a spatial layout of the plurality of hydrocarbon producing wells; and display, for each hydrocarbon well on the list of selected wells that is visible within the overhead view on the display device, an indicia that the hydrocarbon well is on the list of selected wells.

15. The system of claim 14 wherein when the processor displays the indicia, the program further causes the processor to, for each hydrocarbon well visible on the display device, display an indicia of a state of hydrocarbon production associated with the hydrocarbon well.

16. The system of claim 14 wherein when the processor displays the indicia, the program further causes the processor to, for each hydrocarbon well visible on the display device, display an indicia of a reason why the hydrocarbon well is on the list of selected wells.

17. A non-transitory computer-readable medium storing a program that, when executed by a processor, causes the processor to:

acquire, from a data source via a communication network, information about well tests performed on a plurality of hydrocarbon wells tied to one or more production lines within a hydrocarbon producing field;

calculate a first value indicative of an amount of lapsed time since a prior well test was performed for each of the plurality of hydrocarbon wells, based on the acquired information;

obtain, via the communication network from measurement devices coupled to each of the plurality of hydrocarbon wells, measurements of at least one parameter for each of the plurality of hydrocarbon wells;

calculate at least one second value indicative of a change in the at least one parameter for each of the plurality of hydrocarbon wells, based in part on the measurements obtained from the measurements devices coupled to that hydrocarbon well;

determine a well test priority index for each of the plurality of hydrocarbon wells based on the first and second values calculated for that hydrocarbon well;

assign the corresponding well test priority index to each hydrocarbon well in the plurality of hydrocarbon wells;

select a predetermined number of hydrocarbon wells from the plurality of hydrocarbon wells to create a list of selected wells; and display an indication of the hydrocarbon wells on the list of selected wells on a display device coupled to the processor, wherein the displayed indication provides a ranking of the hydrocarbon wells in the list of selected wells, a well test is performed on at least one of the hydrocarbon wells from the list of selected wells based on the ranking, and the well test is performed by:

diverting hydrocarbon flow from the hydrocarbon well through well testing equipment before flowing into the one or more production lines;

measuring parameters associated with the diverted hydrocarbon flow; and determining whether that hydrocarbon well is functioning as expected, based on the measured parameters, and wherein each hydrocarbon well in the list of selected wells is once again tied to the one or more production lines following the well test of that hydrocarbon well.

18. The non-transitory computer-readable medium of claim 17 wherein the measurements obtained for at least one of the plurality of hydrocarbon wells include measurements of the at least one parameter obtained during a prior well test.

19. The non-transitory computer-readable medium of claim 17 wherein the measurements obtained for at least one of the plurality of hydrocarbon wells include measurements of the at least one parameter measured during a period of time when the at least one hydrocarbon well was shut in.

20. The non-transitory computer-readable medium of claim 17 wherein the list of selected wells further includes at least one hydrocarbon well that is selected from the plurality of hydrocarbon wells based on a change in the at least one parameter of a nearby hydrocarbon well.

21. The non-transitory computer-readable medium of claim 17 wherein when the processor displays, the program further causes the processor to:

display on the display device an overhead view of a spatial layout of the plurality of hydrocarbon wells; and display, for each hydrocarbon well on the list of selected wells that is visible within the overhead view on the display device, an indicia that the hydrocarbon well is on the list of selected wells.

22. The non-transitory computer-readable medium of claim 21 wherein when the processor displays the indicia, the program further causes the processor to, for each hydrocarbon well visible on the display device, display an indicia of a state of hydrocarbon production associated with the hydrocarbon well.

23. The non-transitory computer-readable medium of claim 21 wherein when the processor displays the indicia, the program further causes the processor to, for each hydrocarbon well visible on the display device, display an indicia of a reason why the hydrocarbon well is on the list of selected wells.

* * * * *